United States Patent [19]

Goodrich

[11] Patent Number: 4,467,301

[45] Date of Patent: Aug. 21, 1984

[54] ELECTRIC SWITCH HAVING ENHANCED FAULT CURRENT CAPABILITY

[75] Inventor: Ronald W. Goodrich, Logansport, Ind.

[73] Assignee: Essex Group, Inc., Fort Wayne, Ind.

[21] Appl. No.: 412,316

[22] Filed: Aug. 27, 1982

[51] Int. Cl.[3] ..... H01H 79/00

[52] U.S. Cl. ..... 335/195

[58] Field of Search ..... 335/16, 147, 194, 195

[56] References Cited

U.S. PATENT DOCUMENTS

| | | | |
|---|---|---|---|
| 1,754,349 | 4/1930 | Bruhlman | 335/147 |
| 1,762,604 | 6/1930 | Ainsworth | 335/195 |
| 2,944,129 | 7/1960 | Cole et al. | 335/16 |
| 3,419,828 | 12/1968 | Bremer | 335/16 |
| 4,278,958 | 7/1981 | Kandatsu | 335/16 |

*Primary Examiner*—J. D. Miller

*Assistant Examiner*—George Andrews

*Attorney, Agent, or Firm*—Robert D. Sommer

[57] ABSTRACT

In an electric switch having a bridging contact movable into and out of engagement with a pair of fixed contacts, at least one of the terminal elements supporting the fixed contacts comprises a strip of sheet metal folded back upon itself to provide a loop shaped current path with first and second conductive sections extending generally parallel to the bridging contact on opposite sides thereof in close proximity thereto. Attractive forces electrodynamically developed between the bridging contact and the first conductive section of the one terminal element are additive to repulsive forces electrodynamically developed between the bridging contact and the second conductive section of the one terminal element for increasing contact pressure between the bridging contact and the fixed contacts under excessive current conditions.

6 Claims, 5 Drawing Figures

ELECTRIC SWITCH HAVING ENHANCED FAULT CURRENT CAPABILITY

BACKGROUND OF THE INVENTION

This invention relates to electric switches, and particularly to electric switches of the type employing a bridging contact rectilinearly movable into and out of engagement with a pair of fixed contacts.

In electrical power distribution systems, the limiting of peak demand is commonly controlled by selectively disconnecting non-critical residential and office branch circuits. The typical demand control system uses a switching device such as an electromagnetically operated electric switch between the branch circuit and the electric supply system. The switch is normally closed so that the branch circuit is normally connected to the electric supply system and is opened only during high demand periods. Although the branch circuits controlled by the switching devices are equipped with circuit breakers for protection against current overloads, the switching devices may be required to handle high levels of fault currents on the order of 12,000 amperes for short time periods such as five line cycles. When a switch having a bridging contact held against a pair of fixed contacts by a spring is subjected to a fault current, the contact pressure provided by the spring can be overcome by the electrodynamic forces of repulsion developed between the bridging contact and the fixed contacts. Contact separation under these conditions can result in extensive damage to the contacts, if not failure of the switch. While a stronger biasing spring could be employed to ensure adequate contact pressure under fault current conditions, a large mechanical force typically supplied by an electromagnet is required to operate the switch resulting in a larger, more costly switching device.

It has also been proposed to enhance the fault current capability of an electric switch by arranging its current carrying elements to develop electrodynamic forces opposing the forces of repulsion developed between the bridging contact and the fixed contacts. The Ainsworth U.S. Pat. No. 1,762,604 issued June 10, 1930 discloses an auxiliary bridging contact apparatus carried by a main bridging contact member and comprising two movable contact bars pivotally supported in the respective loop-shaped ends of a conductive support. The size and cost of such a complex arrangement is not suited to electric switches intended for use in residential and light industrial applications such as the aforementioned demand control systems. In the Bremer U.S. Pat. No. 3,419,828 issued Dec. 31, 1968, there is disclosed an electric switch with a rigid conducting strip attached to one fixed contact and bent to overlie the bridging contact in cantilever fashion for developing a repulsive force which acts to maintain the bridging contact in engagement with the fixed contacts under heavy excess current conditions. The magnitude of the repulsive force exerted upon the bridging contact in the switch of the latter patent is limited since the bridging contact in its closed position must be spaced from the rigid conducting strip a distance greater than the travel of the bridging contact between its open and closed positions. The location of the switch terminals adjacent each other rather than on opposite sides of the switch is also disadvantageous for some applications.

SUMMARY OF THE INVENTION

The present invention provides an electric switch of the bridging contact type having enhanced fault current capability yet is compact in size, of a low manufacturing cost, and is particularly suited for use in demand control systems and other residential and industrial applications.

In accordance with the present invention, there is provided an electric switch of the type having an elongated bridging contact member rectilinearly movable into and out of engagement with first and second fixed contacts supported respectively on spaced first and second rigid stationary terminal elements. The bridging contact member includes an elongated conductive connecting portion having a contact portion at each of the two opposite ends thereof. Resilient means urge the bridging contact member against the fixed contacts to provide a predetermined normal pressure between the contact portions and the fixed contacts.

At least the first one of the terminal elements comprises an elongated strip of sheet metal folded back upon itself to define a bight and closely spaced first and second sections extending from the bight in generally parallel relation. An integral arm section extends angularly from the distal end of the second section toward the first section and terminates in an extension which is disposed in a longitudinal opening in the first section spaced from the bight. The extension lies substantially in the plane of the first section but in completely spaced relation to the first section. The first contact is secured to the first terminal element at the surface of the extension which faces the second section. At least part of the connecting portion of the bridging contact member extends between the first and second sections in closely spaced relation thereto. The first terminal element is provided with electrical connection means at the distal end of its first section for connecting the switch in an electric circuit. The current flow through the bridging contact member and the current flow through the first section of the first terminal element are in like directions opposite to the direction of current flow through the second section whereby on occurrence of a fault current in the electric circuit including the electric switch a repulsive force is developed between the bridging contact member and the second section and an attractive force is developed between the bridging contact member and the first section which urge the bridging contact member toward the fixed contacts.

In accordance with one embodiment of the invention, the first and second terminal elements are of substantially like construction and are arranged with the bights thereof facing each other. Each of the opposite ends of the bridging contact member extend through a longitudinal slot in the bight of a different one of the terminal elements with a corresponding part of the connecting portion of the bridging contact member disposed between respective ones of the first and second sections in closely spaced relation thereto. The first and second fixed contacts are secured to the first and second terminal elements at the respective surfaces of the extensions which face the second sections for engagement by respective contact portions of the bridging contact member. Each of the first and second terminal elements is provided with electrical connection means at the distal end of its first section for connecting the electric switch in an electric circuit. The current flow through the connecting portion of the bridging contact member and the current flow through the first sections of the terminal elements are in like directions opposite to the direction of current flow through the second sections of the terminal elements.

Also in accordance with the one embodiment of the invention, the width of each second section is of the same order of magnitude as the width of the connecting portion of the bridging contact member. Each first section is generally of a width substantially greater than the width of each second section but has a constricted portion of reduced width intermediate the bight and the longitudinal opening thereof that is aligned with the respective second section thereof. The width of each constricted portion is of the same order of magnitude as the width of the connecting portion of the bridging contact member.

An electric switch according to a preferred form of the one embodiment of the invention further includes support means upon which the terminal elements are mounted in a spaced relationship, and a contact actuator mounted for generally rectilinear movement relative to the support means. The bridging contact member is supported on the contact actuator for generally rectilinear movement toward and away from the fixed contacts. The resilient means back the bridging contact member on the contact actuator to urge the bridging contact member to a closed position in engagement with the fixed contacts.

In accordance with a second embodiment of the invention, the first section of the first terminal element is provided with a longitudinal aperture therein immediately adjacent the bight thereof. The second terminal element includes a tongue disposed in the longitudinal aperture and lying substantially in the plane of the first section but in completely spaced relation to the first section. The second fixed contact is secured to the second terminal element at the surface of the tongue which faces the second section. The bridging contact member is disposed between the first and second section in alignment therewith. The second terminal element also includes electrical connection means connected to the tongue and extending away from the first terminal element for connecting the switch in an electric circuit. The width of each of the first and second sections of the first terminal element is preferably of the same order of magnitude as the width of the connecting portion of the bridging contact member.

An electric switch according to a preferred form of the second embodiment of the invention further includes support means upon which the terminal elements are mounted, and a contact actuator mounted for generally rectilinear movement relative to the support means. The first and second section of the first terminal element are provided with aligned central openings through which the contact actuator extends. The bridging contact member is centrally supported on the contact actuator for generally rectilinear movement toward and away from the fixed contacts. The resilient means back the bridging contact member on the contact actuator to urge the bridging contact member to a closed position in engagement with the fixed contacts. The current path through each of the first and second sections of the first terminal element is divided into two outer branch current paths by the respective one of the central openings. The connecting portion of the bridging contact member is provided with aperture means to divide the current path between the contact portions into two outer branch current paths proximate to the respective outer branch current paths of the first and second sections.

For a better understanding of the invention, reference may be had to the following detailed description taken in connection with the accompanying drawings, in which:

DESCRIPTION OF THE PREFERRED EMBODIMENTS

Figure 1:
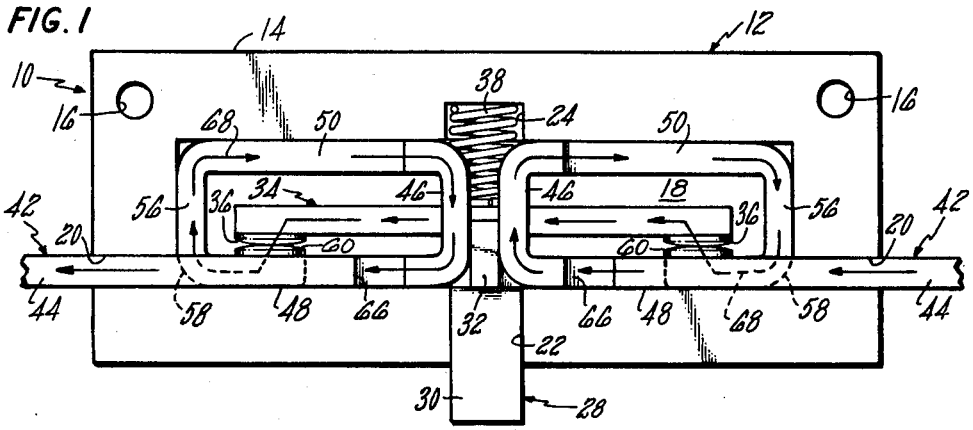
FIG. 1 is a side elevational view on an enlarged scale of an electric switch according to the present invention shown in its normally closed condition and with one housing part removed.
Figure 2:
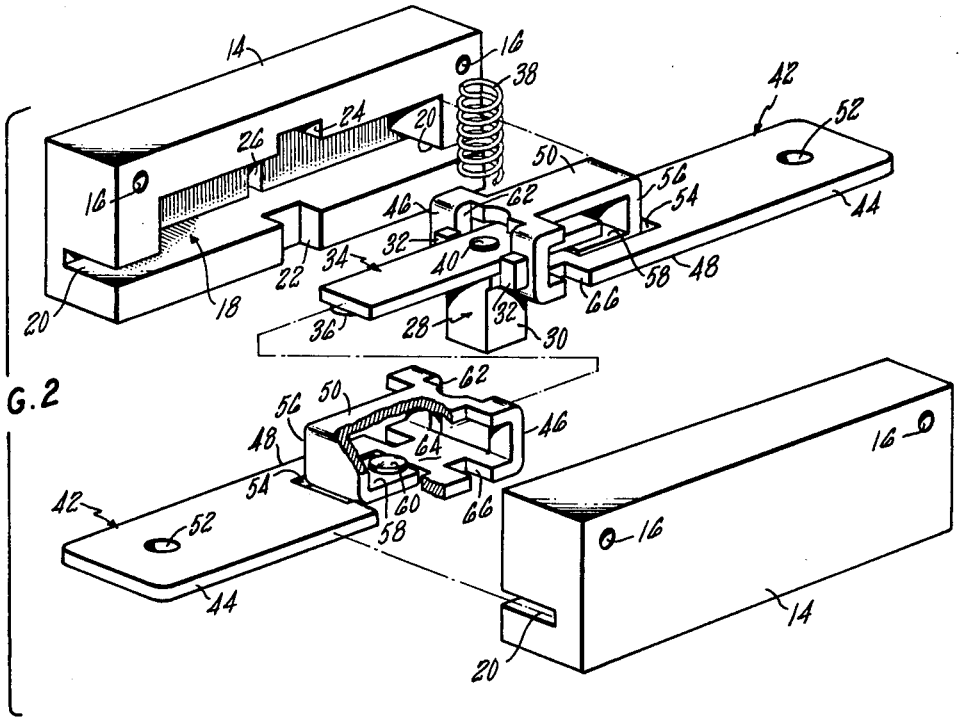
FIG. 2 is a perspective view, partly broken away, of the components of the electric switch of FIG. 1 in a semi-exploded relationship.

Referring now to the drawings, and more particularly to FIGS. 1 and 2 thereof, an electric switch constructed in accordance with the principles of the present invention is generally designated by the reference numeral 10. This switch includes a support or housing 12 which comprises complementary housing parts 14. The housing parts 14 may be made of any suitable insulating material and are firmly held together as a unit by any suitable means such as rivets (not shown) which pass through aligned apertures 16. The housing 12 has a hollow interior defining a switch chamber 18 and has a slot 20 in each of its opposed end walls. The lower wall of the housing 12 is provided at its center with a vertical guideway 22 opening into the switch chamber 18 and a similar cavity 24 is provided in the upper wall of the housing confronting the guideway 22. The side walls of the housing 12 are provided with opposed guide channels 26 in alignment with the guideway 22.

A contact actuator 28 made of any suitable insulating material is arranged for rectilinear reciprocation in the housing 12. The contact actuator 28 comprises a generally rectangular body portion 30 received and guided in the guideway 22 and two outwardly directed shoulders 32 of rectangular cross section received and guided in the guide channels 26. The ends of the shoulders 32 project from the upper surface of the body portion 30 to receive therebetween in interfitting relation the central portion of a bridging contact 34. The bridging contact 34 is preferably made of rigid metal such as copper and has contact elements 36 at its outer ends. A bias spring 38 has its upper end seated in the cavity 24 of the housing 12 and its lower end encircling an upwardly extending boss 40 formed at the center of the bridging contact 34. This spring normally urges the contact actuator 28 and the bridging contact 34 thereon downwardly as shown in FIG. 1.

Two spaced rigid stationary terminal elements 42 of like construction are mounted within the switch chamber 18 with their respective terminal lug sections 44 projecting outwardly through corresponding slots 20 of the housing 12. Each terminal element 42 is formed from an elongated strip of conductive metal such as copper which is folded back upon itself to define a connecting section or bight 46 and closely spaced lower and upper sections 48 and 50 which extend from the bight 46 in generally parallel relation. At its distal end, the lower section 48 is a continuation of the terminal lug section 44 which is provided with an aperture 52 or other suitable electrical connection means to facilitate connection thereof to an electric circuit. The lower section 48 is provided with a longitudinal rectangular opening 54 therein spaced from the bight 46. An integral arm section 56 extends generally perpendicularly from the distal end of the upper section 50 toward the lower section 48 and terminates in an extension 58 disposed in the opening 54. The extension 58 lies substantially in the plane of the lower section 48 but in completely spaced relation thereto without any conductive contact therebetween. A fixed contact 60 is brazed or otherwise secured to the extension 58 on the surface thereof facing the upper section 50. Each bight 46 of the terminal elements 42 is provided with a longitudinal slot 62 for admitting therethrough a respective end of the bridging contact 34 which lies in alignment with and in proximity to the corresponding upper and lower sections 48 and 50 with the contact elements 36 positioned for engagement with the fixed contacts 60. Each lower section 48 has a neck or constricted portion 64 of reduced width intermediate the bight 46 and the opening 54 provided by notches 66 in the sides thereof so as to be in alignment with a respective upper section 50. The upper sections 50 and the constricted portions 64 of the lower sections 48 each have a width substantially equal to that of the bridging contact 34.

In the normally closed position of the switch 10 shown in FIG. 1, the bridging contact 34 is biased into engagement with the fixed contacts 60 by the spring 38. When an actuating force is applied to the contact actuator 28 against the force of the spring 38, the contact actuator 28 carries the bridging contact 34 away from the fixed contacts 60 to an open position. When the contact actuator 28 is released, the spring 38 returns the contact actuator 28 and the bridging contact 34 toward the lowermost closed position. The spring 38 not only provides contact pressure in the closed position but also permits a motion of the bridging contact 34 relative to the contact actuator 28 upon contact engagement to ensure proper mating of the contact elements 36 with the contacts 60 in the closed position.

During operation of the switch 10, a current path indicated by the line 68 extends from the terminal lug section 44 of one terminal element 42 through that terminal element, one contact 60, one contact element 36, the bridging contact 34, the other contact element 36, the other fixed contact 60, and the other terminal element 42 to the terminal lug section 44 thereof. In accordance with this invention, the portion of the current path extending through each of the terminal elements 42 provides a current path loop extending from the distal end of the lower section 48 through the constricted portion 64 of the lower section 48, the bight 46, the upper section 50, and the arm section 56 to the extension 58. Thus, the current flow in the lower section 48 is in a direction opposite to the direction of current flow in the upper section 50 but the same as the direction of current flow in the bridging contact 34. As the upper and lower sections 48 and 50 of the terminal elements 42 extend generally parallel to the bridging contact 34 in close proximity thereto, the magnetic flux produced by current flow through the bridging contact 34 interacts with the magnetic fluxes produced by current flow through the upper and lower sections 48 and 50 to develop electrodynamic forces acting on the bridging contact 34. Current flow in each lower section 48 and the bridging contact 34 of like directions develops an attractive force therebetween which acts to urge the bridging contact 34 toward the lower section 48. Current flow in each of the upper sections 50 in a direction opposite to the direction of current flow through the bridging contact 34 develops a repulsive force which acts to urge the bridging contact 34 toward the lower section 48. Thus these electrodynamic forces are additive in acting to urge the bridging contact 34 against the fixed contacts 60.

Under normal operating conditions, the current flow through the switch 10 develops relatively insignificant electrodynamic forces and the spring 38 maintains the contact elements 36 of the bridging contact 34 in good electrical contact with the fixed contacts 60. On occurrence of a fault current condition, the electrodynamic forces acting on the bridging contact 34 are substantially increased and the pressures between the contact elements 36 and the fixed contact 60 are accordingly proportionally increased.

From the foregoing, it will be apparent that this invention provides a switch structure in which the electrodynamic forces developed as a result of the flow of excessive current therethrough are utilized to increase the contact pressures in the switch. Besides minimizing the possibility of switch failure due to excessive current flow, this permits a reduction in the mechanical operating force requirements of the switch with a resulting reduction in the size and manufacturing cost of the switch.

Figure 3:
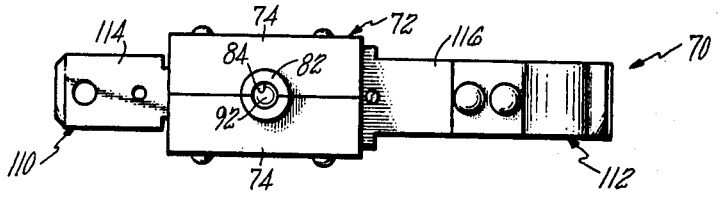
FIG. 3 is a top plan view of an alternate form of an electric switch according to the present invention.
Figure 4:
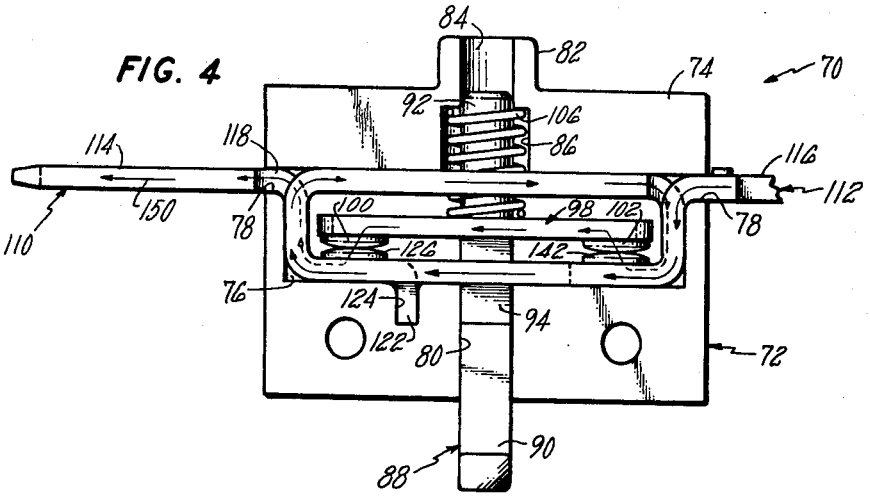
FIG. 4 is a side elevational view on an enlarged scale of the electric switch of FIG. 3 shown in its normally closed condition and with one housing part removed.
Figure 5:
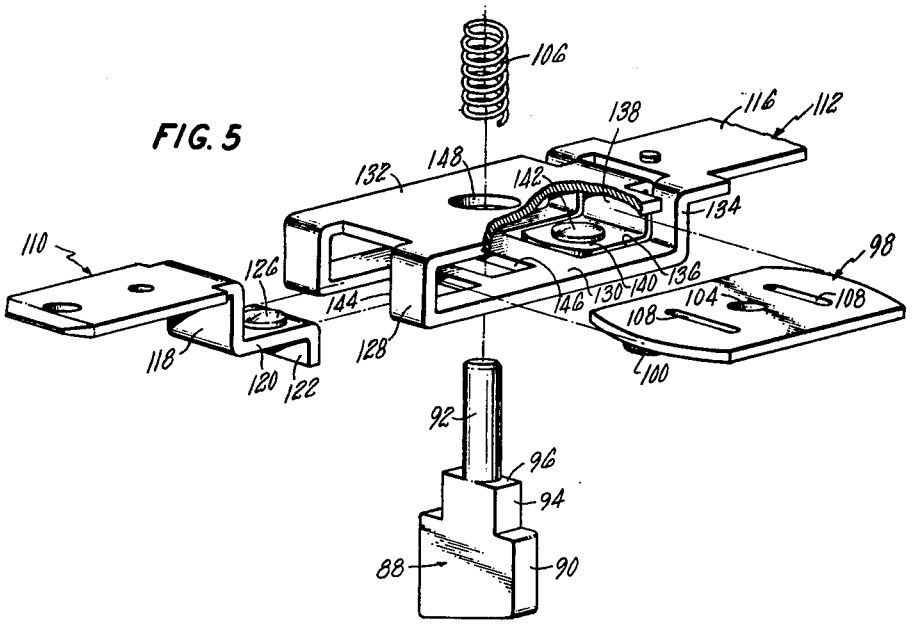
FIG. 5 is a perspective view, partly broken away, on an enlarged scale of the internal components of the electric switch of FIG. 3 in a semi-exploded relationship.

Referring now to FIGS. 3–5, there is shown an electric switch 70 embodying the present invention in an alternate form thereof. The switch 70 includes a support or housing 72 of complementary housing parts 74 which may be connected together in any appropriate fashion. The housing 72 has a hollow interior defining a switch chamber 76 and has a slot 78 in each of its opposed end walls. The lower wall of the housing 72 is provided at its center with a vertical guideway 80 of generally rectangular cross section opening into the switch chamber 76. Opposite the guideway 80, the upper wall of the housing 72 is formed preferably with an upstanding tower 82 having a cylindrical guideway 84 therein that is in communication with the switch chamber 76 through a larger diameter cylindrical passage 86.

A contact actuator 88 made of any suitable insulating material is slidably supported in the housing 72 for rectilinear reciprocation. The contact actuator 88 has at one end a generally rectangular body portion 90 received and guided in the guideway 80 and has at its other end a cylindrical shaft portion 92 received and guided in the guideway 84. The portions 90 and 92 of the contact actuator are joined to an intermediate rectangular body portion 94 which provides a shoulder 96 adjacent the shaft portion 92. A bridging contact 98 made of rigid copper is fitted upon the shaft portion 92 and has contact elements 100 and 102 at its respective outer ends. The central aperture 104 of the bridging contact 98 has a diameter slightly greater than that of the shaft portion 92 so that the bridging contact 98 may float on the shaft portion 92. The bridging contact 98 is biased or backed against the shoulder 96 of the contact actuator 88 by a compression spring 106 which has its upper end seated in the passage 86. The spring 106 normally urges the contact actuator 88 and the bridging contact 98 thereon downwardly as shown in FIG. 4. For a purpose to be subsequently explained, the bridging contact 98 is provided with a pair of parallel elongated apertures 108 therein transversely disposed across a central connecting portion of the bridging contact 98 intermediate the contact elements 100 and 102.

Two spaced rigid stationary terminal elements 110 and 112 are mounted within the switch chamber 76 with their respective terminal lug sections 114 and 116 projecting outwardly through corresponding slots 78 of the housing 72. The terminal element 110 is of conductive metal such as copper and includes within that portion disposed within the switch chamber 76 an angled section 118 of reduced width terminating in a lateral extension or tongue 120. The tongue 120 is provided with means such as a tab 122 which is snugly engaged in an opening 124 in the housing 72 to prevent displacement of the terminal element 110 therefrom. The tongue 120 carries a fixed contact 126 adapted for engagement by the confronting contact element 100 on the bridging contact 98.

The terminal element 112 is formed from an elongated strip of conductive metal such as copper which is folded back upon itself to define a connecting section or bight 128 and closely spaced lower and upper sections 130 and 132 which extend from the bight 128 in generally parallel relation. The lower section 130 is joined at its distal end to the terminal lug section 116 by an angled section 134 and is provided with a longitudinal rectangular opening 136 therein which is preferably extended through the angled section 134 to the terminal lug section 116. An integral arm section 138 extends generally perpendicularly from the distal end of the upper section 132 toward the lower section 130 and terminates in an extension 140 disposed in the opening 136. The extension 140 lies substantially in the plane of the lower section 130 but in completely spaced relation thereto without any conductive contact therebetween. A fixed contact 142 is brazed or otherwise secured to the extension 140 on the surface facing the upper section 132 for engagement by the confronting contact element 102 of the bridging contact 98. At its proximal end, the lower section 130 is provided with a longitudinal rectangular aperture 144 therein which is preferably extended through the bight 128. The tongue 120 of the terminal element 110 is disposed in this aperture 144 and lies substantially in the plane of the lower section 130 but in completely spaced relation thereto without any conductive contact between the terminal elements 110 and 112. The lower section 130 and the upper section 132 are provided with respective aligned central openings 146 and 148 for freely admitting therethrough the corresponding portions 92 and 94 of the contact actuator 88. The bridging contact 98 is disposed between the lower section 130 and the upper section 132 in alignment with and in proximity to the sections 130 and 132. The latter two sections each have a width substantially equal to that of the bridging contact 98.

In the normally closed condition of the switch 70 shown in FIG. 4, the bridging contact 98 is biased into engagement with the fixed contacts 126 and 142 by the spring 106. When an actuating force is applied to the contact actuator 88 against the force of the spring 106, the contact actuator 88 carries the bridging contact 98 away from the fixed contacts 126 and 142 to an open position. When the contact actuator 88 is released, the spring 106 returns the contact actuator 88 and the bridging contact 98 toward the lowermost closed position. The spring 106 not only provides contact pressure in the closed position but also permits a motion of the bridging contact 98 relative to the contact actuator 88 upon contact engagement to ensure proper mating of the contact elements 100 and 102 with the respective fixed contacts 126 and 142 in the closed position.

During the operation of the switch 70, a current path indicated by the line 150 extends from the terminal lug section 116 of terminal element 112 through that terminal element, the fixed contact 142, the contact element 102, the bridging contact 98, the contact element 100, the fixed contact 126, and the terminal element 110 to the terminal lug section 114 thereof. It will be apparent that the current flow in the lower section 130 is in a direction opposite to the direction of current flow in the upper section 132 but the same as the direction of current flow in the bridging contact 98. It will also be noted that the current path through the upper section 132 is effectively divided into two outer branch current paths by the central opening 148 and that the current path through the lower section 130 is also effectively divided into two outer branch current paths by the central opening 146 as well as by the opening 136 and the aperture 144. Likewise, the current path through the bridging contact 98 is effectively divided into two outer branch current paths proximate to the respective outer branch current paths of the sections 130 and 132 by the provision of the elongated apertures 108 in the bridging contact 98.

As the lower and upper sections 130 and 132 of the terminal element 112 extend generally parallel to the bridging contact 98 in close proximity thereto, the magnetic flux produced by current flow through the bridging contact 98 interacts with the magnetic fluxes produced by current flow through the lower and upper sections 130 and 132 to develop electrodynamic forces acting on the bridging contact 98. Current flow of like directions in the lower section 130 and the bridging contact 98 develops an attractive force therebetween which acts to urge the bridging contact 98 toward the lower section 130. Current flow in the upper section 132 in a direction opposite to the direction of current flow through the briding contact 98 develops a repulsive force which acts to urge the bridging contact 98 toward the lower section 130. Thus, these electrodynamic forces are additive in acting to urge the bridging contact 98 against the fixed contacts 126 and 142.

Under normal operating conditions, the current flow through the switch 70 develops relatively insignificant electrodynamic forces and the spring 106 maintains the contact elements 100 and 102 of the bridging contact 98 in good electrical contact with the fixed contacts 126 and 142. On occurrence of a fault current condition, the electrodynamic forces acting on the bridging contact 98 are substantially increased and the pressure between the contact elements 100 and 102 and the fixed contacts 126 and 142 are accordingly proportionally increased. Thus, the alternate construction also results in a switch 70 in which the electrodynamic forces developed as a result of the flow of excessive current therethrough are utilized to increase the contact pressures in the switch 70.

While there has been described above the principles of this invention in connection with two specific switch constructions, it is to be understood that this description is made only by way of example and not as a limitation to the scope of the invention.

What is claimed is:

1. An electric switch comprising: support means; first and second rigid stationary terminal elements mounted on said support means in a spaced relationship; first and second fixed contacts supported respectively on said first and second terminal elements; an elongated bridging contact member comprising a flat conductive blade having a contact portion at each of the two opposite ends thereof; a contact actuator mounted for generally rectilinear movement relative to said support means and supporting said bridging contact member for generally rectilinear movement therewith; said contact actuator being movable rectilinearly to move said bridging contact member toward said fixed contacts to a closed position in engagement with said fixed contacts and away from said fixed contacts to an open position spaced from said fixed contacts; resilient means backing said bridging contact member on said contact actuator and urging said bridging contact member against said fixed contacts to provide a predetermined normal pressure between said contact portions and fixed contacts in the closed position of said bridging contact member; at least one of said terminal elements comprising an elongated strip of sheet metal folded back upon itself to define a bight and closely spaced first and second sections extending from said bight in generally parallel relation; said first section being provided with a longitudinal opening therein spaced from said bight; an integral arm section extending angularly from the distal end of said second section toward said first section and terminating in an extension disposed in said opening in said first section; said extension lying substantially in the plane of said first section but in completely spaced relation to said first section; one of said fixed contacts being secured to said at least one terminal element at the surface of said extension which faces said second section; at least part of said bridging contact member extending between said first and second sections in closely spaced and axially parallel relation thereto but rectilinearly movable therebetween; and said at least one terminal element being provided with electrical connections means at the distal end of said first section for connecting the electric switch in an electric circuit; the current flow through said bridging contact member and the current flow through said first section being in like directions opposite to the direction of current flow through said second section whereby on occurrence of a fault current condition in the electric circuit including the electric switch a repulsive force is developed between said bridging contact member and said second section and an attractive force is developed between said bridging contact member and said first section which urge said bridging contact member toward said fixed contacts.

2. The electric switch of claim 1 wherein said first and second terminal elements are of substantially like construction and arranged with the bights thereof facing each other; each of said bights being provided with a longitudinal slot for admitting therethrough a respective end of said bridging contact member; each of the opposite ends of said bridging contact member extending through the slot in the bight of a different one of said first and second terminal elements with a corresponding part of said bridging contact member disposed between respective ones of said first and second sections in closely spaced and axially parallel relation thereto; said first and second fixed contacts being secured to said first and second terminal elements at the respective surfaces of said extensions which face said second sections for engagement by respective contact portions of said bridging contact member; and each of said first and second terminal elements being provided with electrical connection means at the distal end of its said first section for connecting the electric switch in an electric circuit; the current flow through said bridging contact member and the current flow through said first sections of the terminal elements being in like directions opposite to the direction of current flow through said second sections of the terminal elements whereby on occurrence of a fault current condition in the electric circuit including the electric switch a repulsive force is developed between said bridging contact member and said second sections and an attractive force is developed between said bridging contact member and said first sections which urge said bridging contact member toward said fixed contacts.

3. The electric switch of claim 2 wherein the width of each of the second section is of the same order of magnitude as the width of said bridging contact member; each of said first sections being generally of a width substantially greater than the width of each of said second sections; the first section of each of said terminal elements having a constricted portion of reduced width intermediate the bight and longitudinal opening thereof that is aligned with the respective second section thereof; and the width of each said constricted portion being of the same order of magnitude as the width of said bridging contact member.

4. In an electric switch comprising spaced first and second rigid stationary terminal elements each formed of an electrical conductive material, first and second fixed contact supported respectively on said first and second terminal elements, an elongated bridging contact member rectilinearly movable into and out of engagement with said fixed contacts and including an elongated conductive connecting portion having a contact portion at each of the two opposite ends thereof, and resilient means urging said bridging contact member against said fixed contacts to provide a predetermined normal pressure between said contact portions and said fixed contact; the improvement wherein said first terminal element comprises an elongated strip of sheet metal folded back upon itself to define a bight and closely spaced first and second sections extending from said bight in generally parallel relation; said first section being provided with a longitudinal opening therein spaced from said bight and with a longitudinal aperture therein immediately adjacent the bight thereof; an integral arm section extending angularly from the distal end of said second section toward said first section and terminating in an extension disposed in said opening in said first section; said extension lying substantially in the plane of said first section but in completely spaced relation to said first section; said first fixed contact being secured to said first terminal element at the surface of said extension which faces said second section; said second terminal element including a tongue disposed in said aperture in said first section; said tongue lying substantially in the plane of said first section but in completely spaced relation to said first section; said second fixed contact being secured to said second terminal element at the surface of said tongue which faces said second section; said bridging contact member being disposed between said first and second sections in closely spaced relation thereto and in alignment therewith; and said first terminal element being provided with electrical connection means at the distal end of said first section and said second terminal element including further electrical connection means connected to said tongue and extending away from said first terminal element for connecting the electric switch in an electric circuit; the current flow through said bridging contact member and the current flow through said first section being in like directions opposite to the direction of current flow through said second section whereby on occurrence of a fault current condition in the electric circuit including the electric switch a repulsive force is developed between said bridging contact member and said second section and an attractive force is developed between said bridging contact member and said first section which urge said bridging contact member toward said fixed contacts.

5. The electric switch of claim 4 wherein the width of each of the first and second sections of said first terminal element is of the same order of magnitude as the width of the connecting portion of said bridging contact member.

6. The electric switch of claim 5 including support means upon which said terminal elements are mounted and a contact actuator mounted for generally rectilinear movement relative to said support means; said first and second sections of said first terminal element being provided with aligned central openings through which said contact actuator extends; said bridging contact member being centrally supported on said contact actuator for generally rectilinear movement toward said fixed contacts to a closed position and away from said fixed contacts to an open position; said resilient means backing said bridging contact member on said contact actuator to urge said bridging contact member to the closed position; the current path through each of said first and second sections being divided into two outer branch current paths by the respective one of said central openings; and the connecting portion of said bridging contact member being provided with aperture means to divide the current path between said contact portions into two outer branch current paths proximate to the respective outer branch current paths of said first and second sections.

* * * * *